US007423241B2

(12) United States Patent
Hanson

(10) Patent No.: US 7,423,241 B2
(45) Date of Patent: Sep. 9, 2008

(54) HEATING ELEMENT FOR OVEN

(75) Inventor: Benjamin W. Hanson, Staughton, WI (US)

(73) Assignee: Wolf Appliance, Inc., Madison, WI (US)

( * ) Notice: Subject to any disclaimer, the term of this patent is extended or adjusted under 35 U.S.C. 154(b) by 33 days.

(21) Appl. No.: 11/519,566

(22) Filed: Sep. 12, 2006

(65) Prior Publication Data

US 2008/0083728 A1 Apr. 10, 2008

(51) Int. Cl.
*A21B 1/14* (2006.01)
*A21B 1/22* (2006.01)

(52) U.S. Cl. ..... 219/407; 219/402

(58) Field of Classification Search ..... 219/402, 219/407

See application file for complete search history.

(56) References Cited

U.S. PATENT DOCUMENTS 1,225,827 A * 5/1917 Kuhn et al. ..... 219/520
2,498,583 A * 2/1950 Schulze ..... 219/403
2,752,476 A * 6/1956 Norris ..... 219/402
4,675,507 A * 6/1987 Akiyoshi et al. ..... 219/406
4,880,952 A * 11/1989 Hirai et al. ..... 219/685
6,121,584 A * 9/2000 Key et al. ..... 219/407
6,871,379 B2 3/2005 Ebeling et al.
6,943,321 B2 9/2005 Carbone et al.
7,102,105 B2 9/2006 Oh
7,312,423 B2 * 12/2007 Idomoto et al. ..... 219/402

* cited by examiner

*Primary Examiner*—Joseph M Pelham
(74) *Attorney, Agent, or Firm*—Foley & Lardner LLP

(57) ABSTRACT

The oven includes an oven chamber and a heating element. The oven chamber includes a cavity defined by a door and a plurality of walls which include a first wall, and a heating element assembly located adjacent the first wall and configured to provide heat energy to the cavity. The heating element assembly includes a heating element and a shield located between the heating element and the first wall of the oven chamber. The heating element transfers heat energy to the shield and the surrounding air, which transfers the heat energy to the first wall.

19 Claims, 8 Drawing Sheets

HEATING ELEMENT FOR OVEN

BACKGROUND

The present application relates to a heating element for an oven. More specifically, the present application relates to a hidden oven heating element that improves heat distribution being emitted from the bottom of an oven cavity.

Ovens mounted in a wall or as part of a range are generally known. Such ovens typically include an oven chamber defined by a plurality of walls and a door, and may include a "hidden" heating element mounted below the over chamber. The heating element typically comprises one or more long rods with many bends to form a heat element "panel" (due to the closeness and number of the bends). The heat element is typically centrally located just above or below (when "hidden") the bottom wall (i.e., midway between the front of the oven chamber and the back of the oven chamber). When mounted below the bottom wall of the oven chamber, the heating element is typically surrounded by insulation to direct the heat energy upward to the bottom wall of the oven chamber that is directly above the heating element.

However, such heating elements have several disadvantages including: localized hot spots on the bottom of the oven chamber from intense radiation produced by the heating element and causing heat stresses on the oven cavity, air heated by the heating element is not allowed to heat the entire bottom wall of the oven chamber, the heating element not positioned proximate the portion of the oven chamber that has the most heat loss, and difficult to access for servicing.

Accordingly, it would be advantageous to provide an inexpensive, reliable, and widely adaptable heating element that avoids the above-referenced and other problems would represent a significant advance in the art. For example, it would also be advantageous to provide a heating element that provides improved heat distribution to the bottom wall of the oven chamber to evenly distribute heat energy, to enhance cooking performance and self-cleaning performance, and to reduce heat stress on the bottom wall of the oven chamber. It would also be desirable to provide a shield between the heating element and the bottom wall of the oven chamber to evenly distribute heat energy, surrounding the heating element assembly with air rather than insulation to allow air flow across the bottom surface of the bottom wall. It would further be advantageous to shift the heating element forward relative to the oven chamber (i.e., closer to the door) to be closer to the portion of the oven with the greatest amount of heat loss (i.e., the door). It would further be advantageous to provide an access panel to simply and easily access the heating element for inspection, replacement, or the like. It would be desirable to provide for a heating element having one or more of these or other advantageous features.

SUMMARY

The present invention relates to an oven comprising an oven chamber and a heating element. The oven chamber comprises a cavity defined by a door and a plurality of walls which include a first wall, and a heating element assembly located adjacent the first wall and configured to provide heat energy to the inside of the cavity. The heating element assembly comprises a heating element and a shield located between the heating element and the first wall of the oven chamber. The heating element transfers heat energy to the surrounding air and shield and the hot air and shield transfers the heat energy to the first wall.

The present invention also relates to an oven comprising an oven chamber and a heating element. The oven chamber comprises a cavity formed by a pair of opposing side walls, a rear wall, a door opposite the rear wall, and a bottom wall. The cavity comprises a plane extending midway between the rear wall and the door and generally parallel with the door. The heating element is located below the bottom wall and having a geometric center point. The center of the heating element is located between the plane of the cavity and the door so that more heat is provided to a front portion of the cavity (where more heat loss occurs) than a rear portion of the cavity.

The present invention further relates to an oven comprising an oven chamber and a heating element. The oven chamber comprises a cavity formed by a pair of opposing side walls, a rear wall, a door opposite the rear wall, a bottom wall. The cavity comprises a first plane extending midway between the rear wall and the door and dividing the cavity into a rear portion and a front portion. The heating element is located below the bottom wall and comprising a heating element and a shield located between the heating element and the bottom wall of the oven chamber. The heating element transfers heat energy to the surrounding air and shield and the hot air and shield transfers heat energy to the bottom wall. A geometric center of the heating element is located between the plane and a second plane extending through the door so that more heat is provided to the front portion of the cavity than the rear portion of the cavity The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF THE PREFERRED EMBODIMENTS

Figure 1:
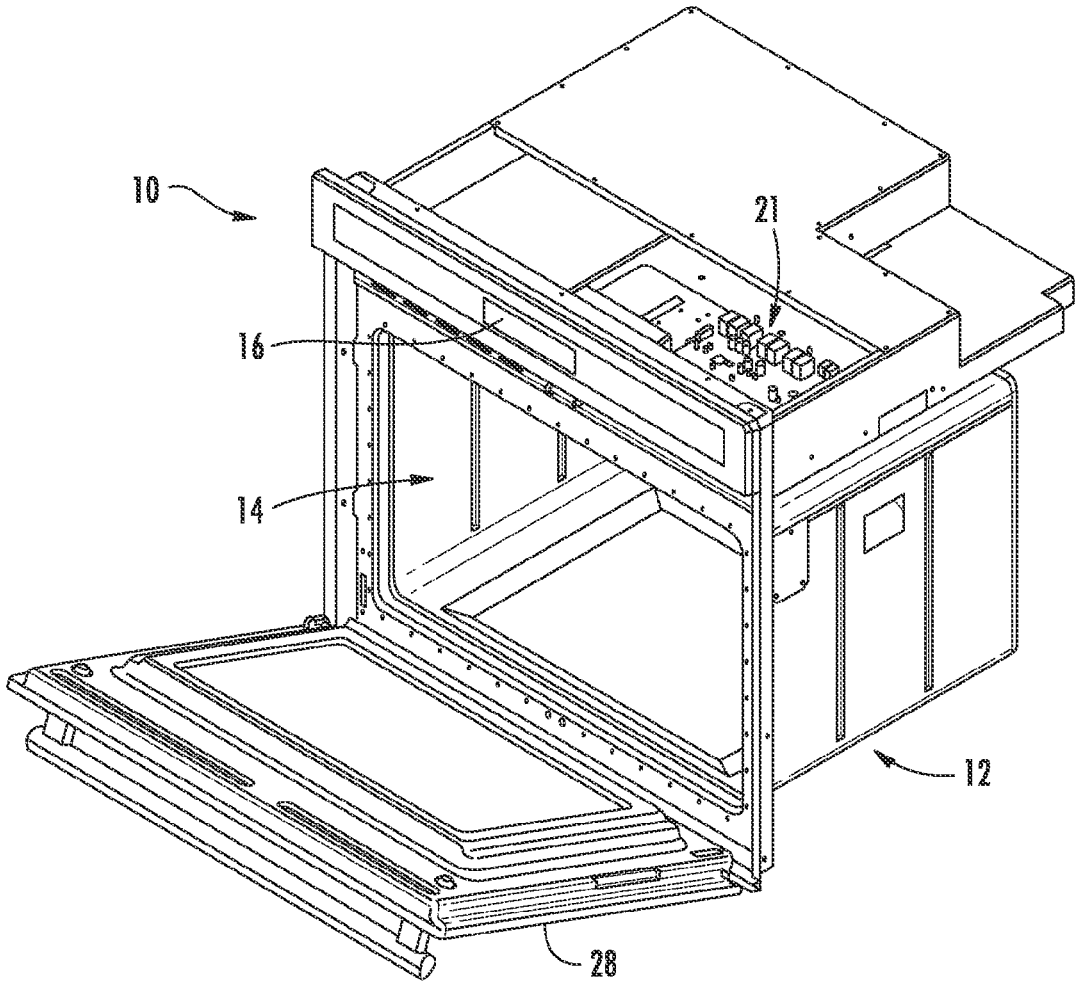
FIG. 1 is a front view of an oven according to an exemplary embodiment.
Figure 2:
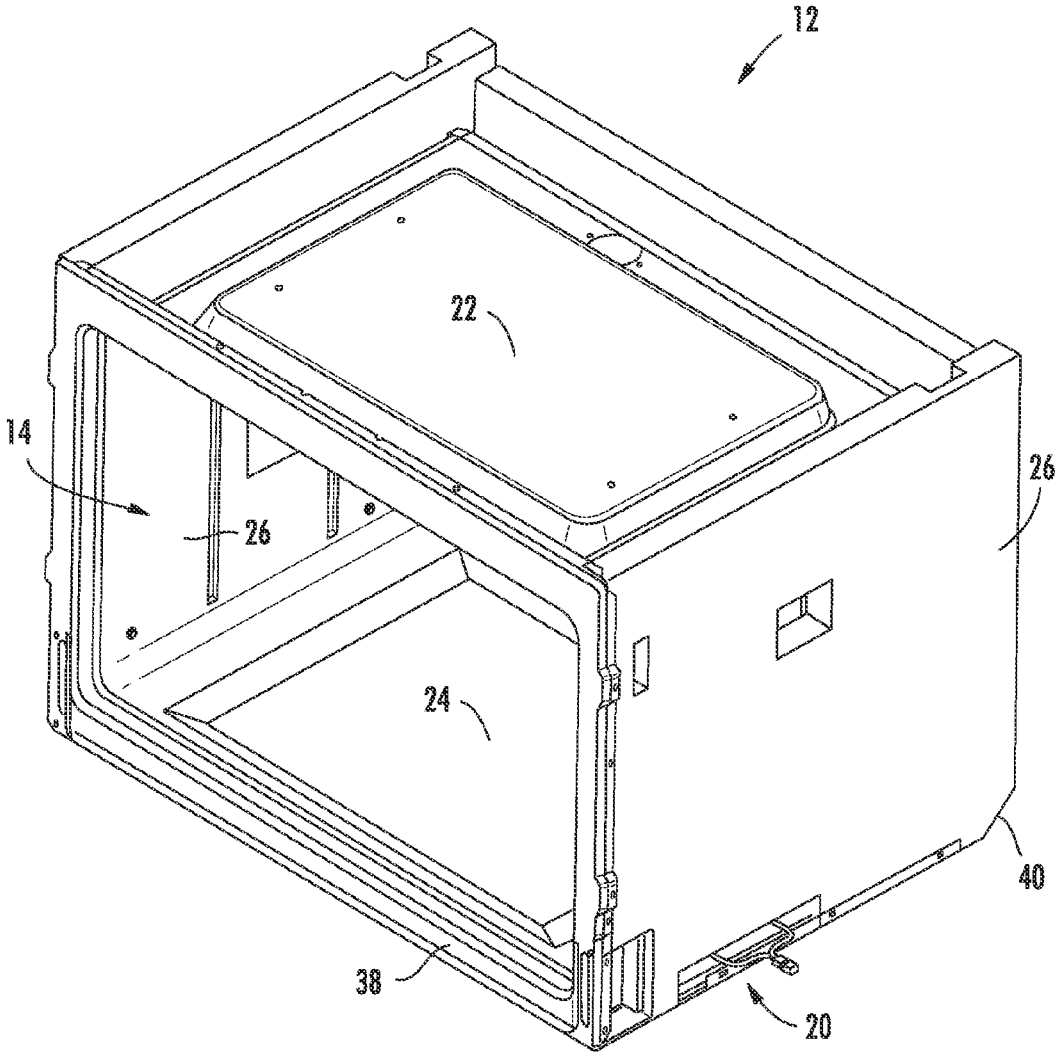
FIG. 2 is a top perspective view of an oven chamber of the oven of FIG. 1.
Figure 3:
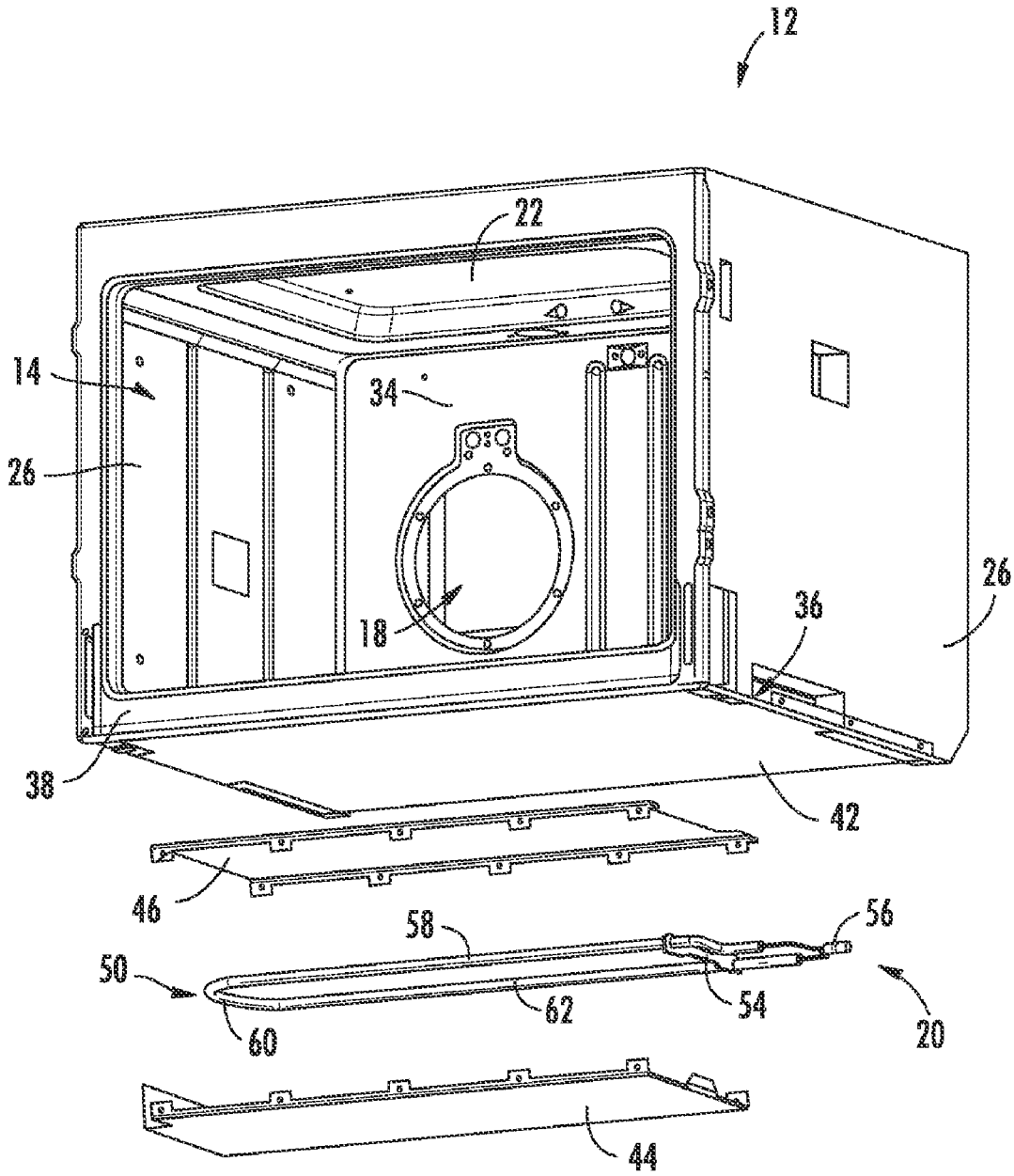
FIG. 3 is an exploded perspective view of the oven chamber and heating element assembly of FIG. 2.

Referring to FIGS. 1 and 3, a forced air convection oven 10 is shown according to an exemplary embodiment. Oven 10 comprises an oven chamber 12 surrounding an internal cavity 14, a user interface 16, one or more convection heat sources, and a heating element assembly 20. User interface 16 provides a temperature selector input and a mode selector input.

A controller 21 regulates oven cavity air temperature by monitoring the temperature selector and feedback from a temperature sensor and setting the operating state of the convection heat sources and the heating element source in accordance with the selected mode of cooking.

Referring to FIGS. 1-4, oven chamber 12 has a plurality of walls surrounding (defining) oven cavity 14, and including a top wall 22, a bottom wall 24, side walls 26, and a door 28 at the front of oven 10 to permit food to be placed in and removed from oven cavity 14. Food to be cooked can be placed on a plurality of adjustable-elevation horizontal racks (not shown) in oven cavity 14. A plurality of rack supports may be provided on the oven side walls 26 for this purpose. According to a preferred embodiment, the shape of oven cavity 14 is typically square or rectangular, but it could include curved or angled walls.

According to an exemplary embodiment, the convection heat source is located at openings 18 and includes two blower units (not shown) located horizontally adjacent to one another opposite the oven door 28 and are mounted on a back wall 34. Such a convection or flow-through oven, for example, may incorporate any number of adjacent blowers to adapt to the size of oven chamber 12. Similarly, the oven can be adapted to any suitable dimension of a substantially enclosed oven chamber. According to an alternative embodiment, the oven is provided without a convection heat source such that heating of the oven cavity is provided by the heating element assembly.

Heating element assembly 20 is configured to provide radiant heat to oven cavity 14. Heating element assembly 20 is mounted below bottom wall 24 of oven cavity 14 in an open space 36 defined by bottom wall 24 (of cavity 14), a front wall 38, side walls 26, a rear (angled) wall 40, and a sub wall 42. Heating element assembly 20 includes a base bracket 44, a top bracket 46, an insulation shield 48, and a heating element 50. Base bracket 44 provides structural support to the other components and mounts to the oven sub wall 42. Top bracket 46 couples to base bracket 44 (e.g., by snap fit, fasteners such as screws, bolts, rivets, etc.) to enclose or encapsulate heating element 50. According to an alternative embodiment, the heating assembly is mounted adjacent to any of the other walls.

Insulation shield 48 is coupled to base bracket 44 and/or top bracket 46, and is manufactured to be thermally non-conductive. For example, insulation shield 48 is preferably made from thermally non-conductive material such as fiberglass. Also, insulation shield 48 is designed to be shaped to be thermally non-conductive (e.g., generally planer, thin wall thickness, etc.). Alternatively, any of a variety of thermally non-conductive materials or configurations may be used.

Heating element 50 emits heat by providing a resistance to a current passing through element 50 (e.g., made of a resistive element such as a Calrod heating element). According to an exemplary embodiment, heating element 50 comprises a continuous member, a mounting bracket 54, and an electrical connector 56. The continuous member is formed to have a front portion 58, at least one middle or side portion 60, and a rear portion 62. Preferably, member 52 is formed into a "U" shape or rectangle/square. Alternatively, the member may have any of a variety of shapes and configurations. Alternatively, the heating element comprises other types of heat source, such as infra red source, gas-fired sources, of the like. By acting as a thermal non-conductive conduit, shield 48 allows the element 50 to be formed into a more efficient shape.

Referring to FIGS. 5-8, heating element assembly 20 is surrounded (e.g., encompassed, etc.) by open space 36 without any insulation material between heating element assembly 20 and front wall 38, side walls 39, bottom wall 24 (of the oven cavity 14) and the sub wall 42. As such, heating element 50 heats the air throughout open space 36, thereby allowing cooler air and warmer air in the open space 36 to mix and reach a consistent/uniform temperature.

Radiant heat is provided to oven cavity 14 by heat energy emitted from heating element 50 being absorbed by top bracket 46 and then insulation shield 48. Insulation shield 48 absorbs the heat energy rather than bottom wall 24 of cavity 14 directly absorbing the heat energy from heating element 50. The thermal conductive properties of insulation shield 48 spreads the heat energy throughout and across its surface to minimize or reduce localized areas of higher temperature (hot spots).

Figure 7:
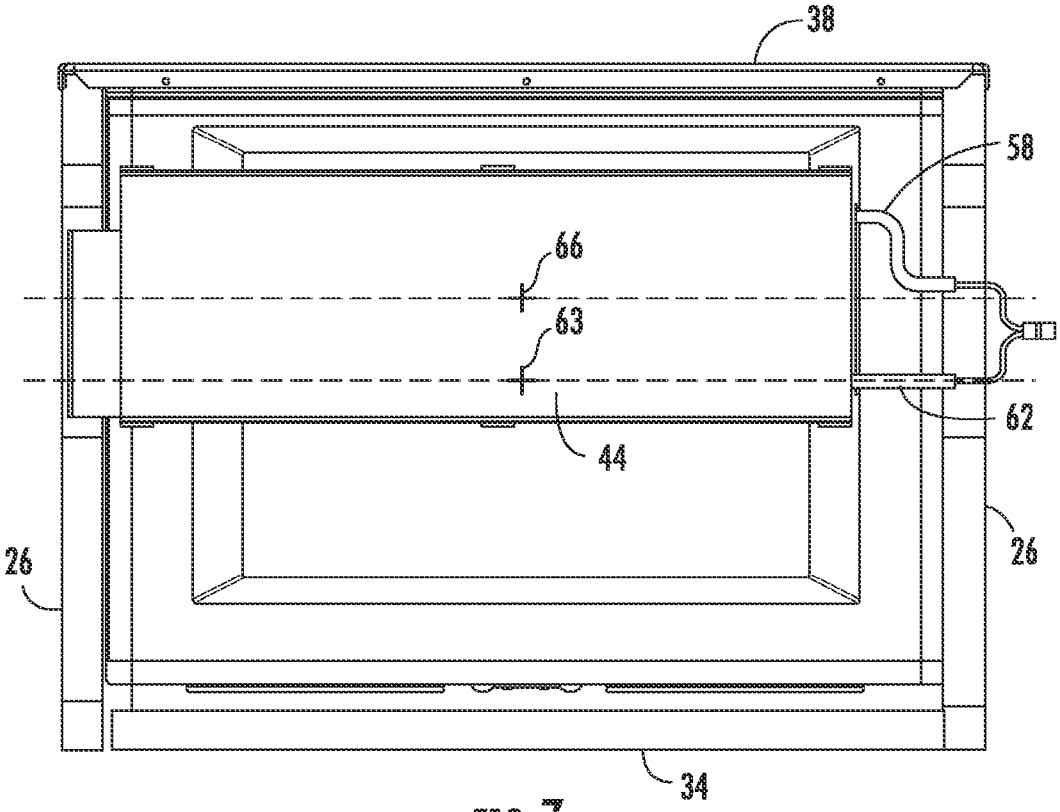
FIG. 7 is bottom plan view of the heating element assembly positioned relative to the oven chamber according to an exemplary embodiment.
Figure 8:
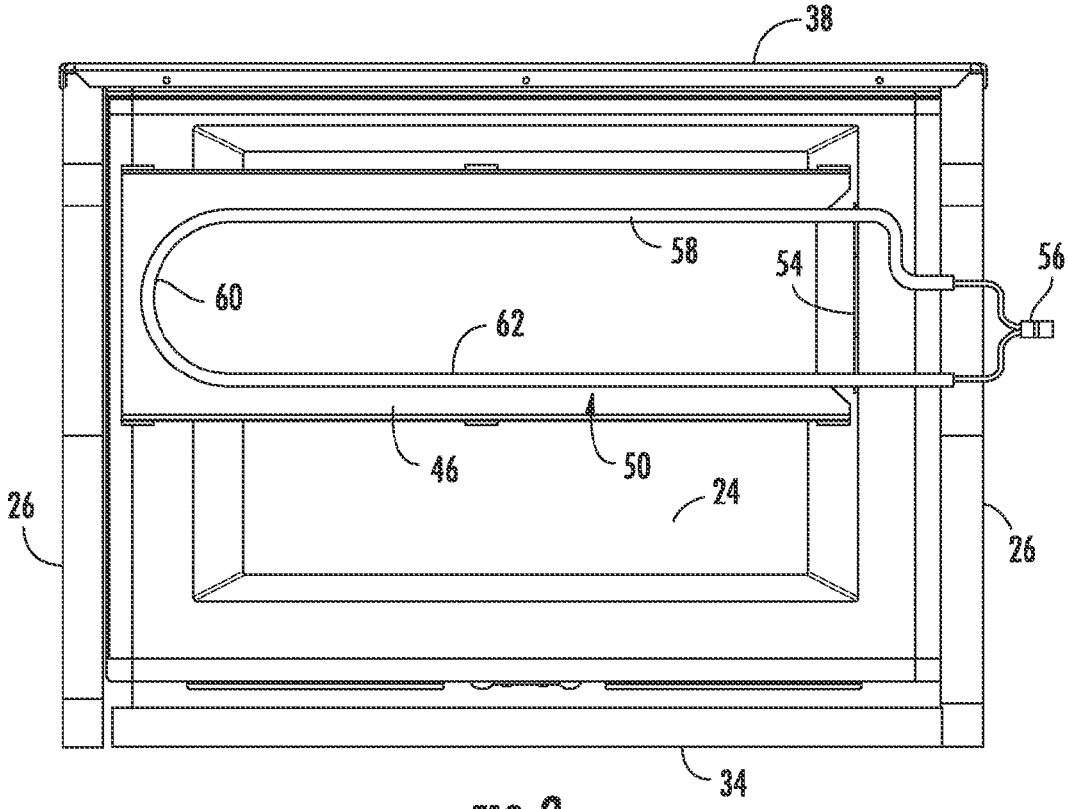
FIG. 8 is bottom plan view of the heating element assembly positioned relative to the oven chamber and with a bottom bracket removed.

According to a preferred embodiment shown in FIGS. 7 and 8, heating element 50 (and heating element assembly 20) has a geometric center or a centerline 66 that is located forward (i.e., closer to door 28) of a geometric center or centerline 68 of oven cavity 14. Heating element 50 may be completely forward of centerline 68 (i.e., between centerline 68 and door 28) or straddle (have portions of element on both sides of centerline). The center of the element is between a plane (which extends through a center of the cavity and generally parallel with the door) and the door.

Figure 4:
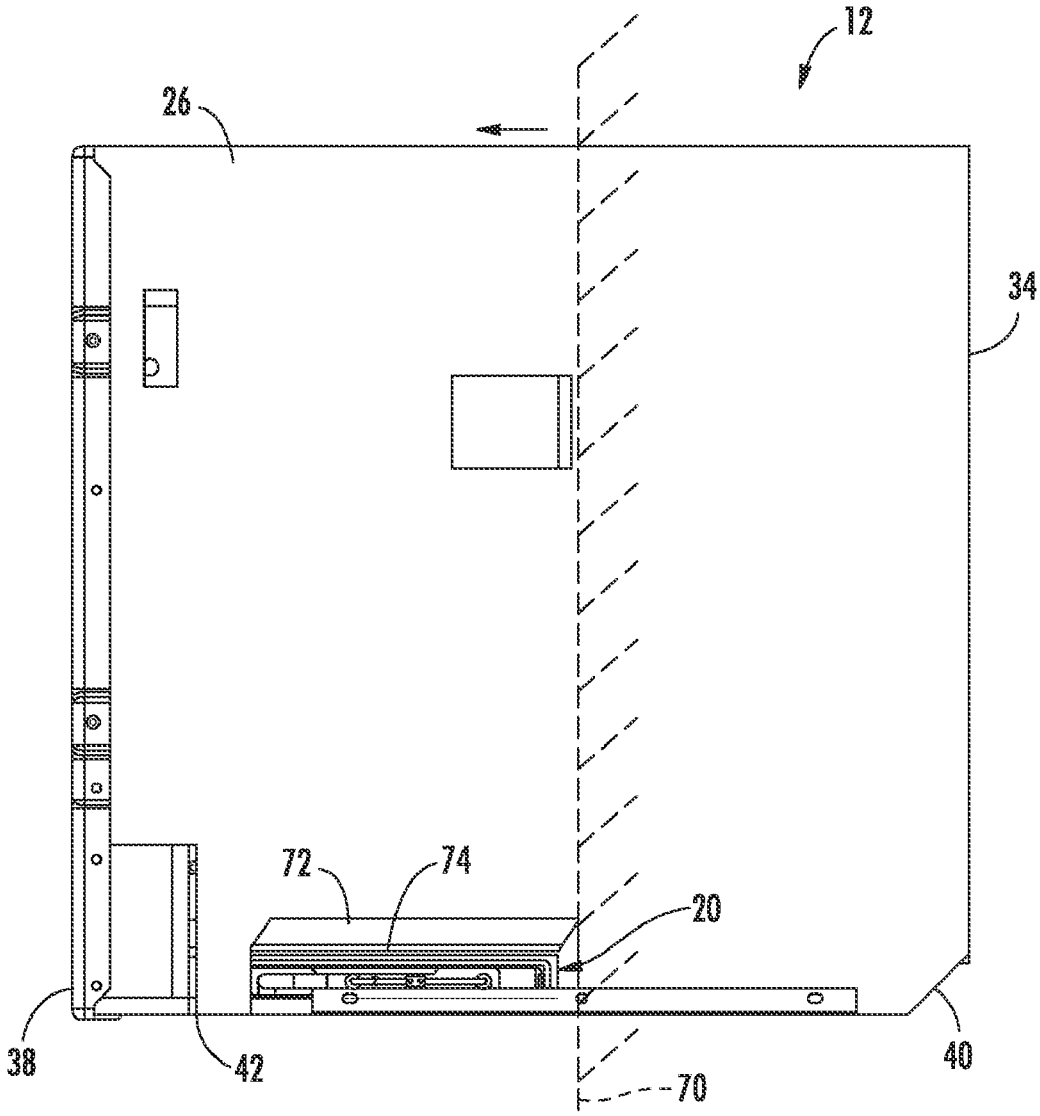
FIG. 4 is a side elevation view of the oven chamber of FIG. 2.
Figure 5:
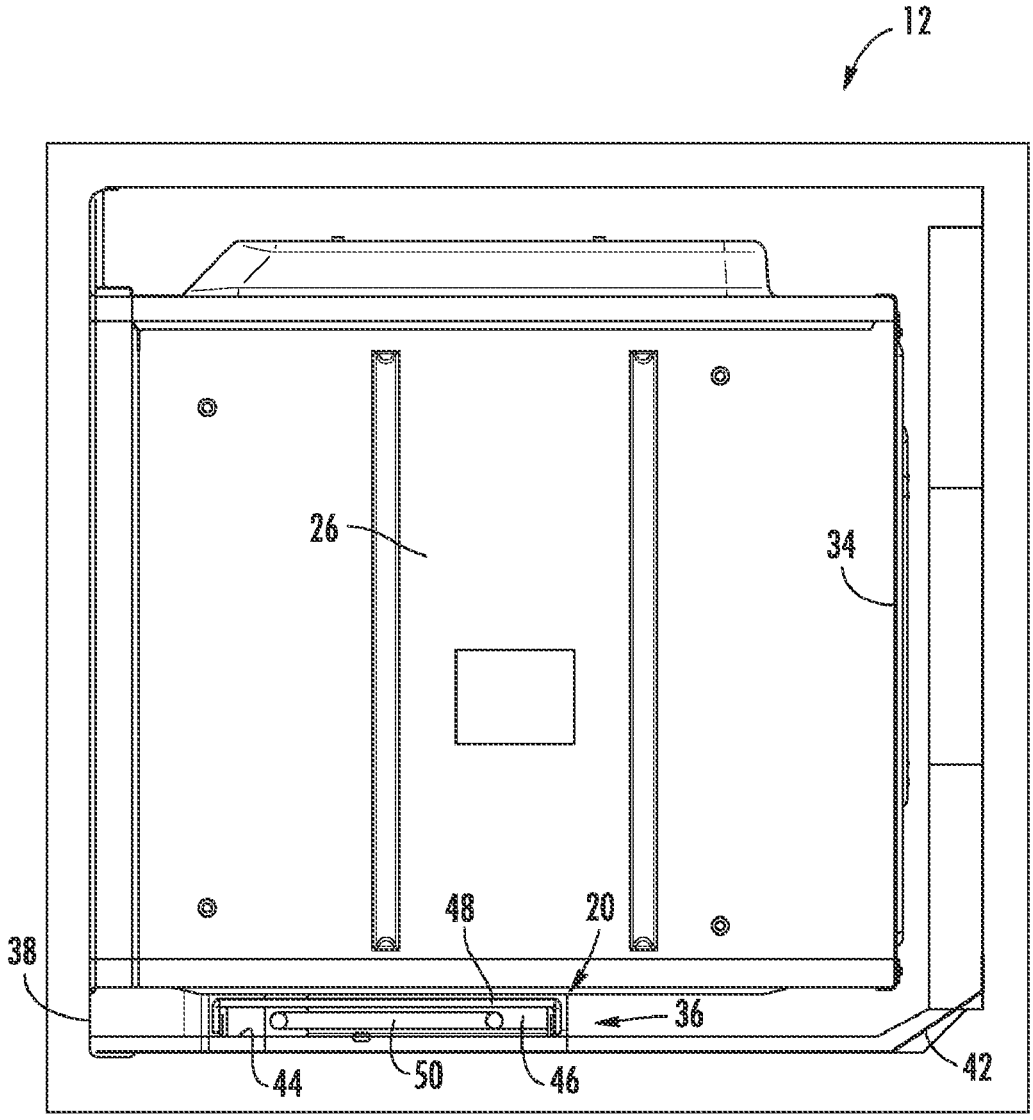
FIG. 5 is a side sectional view of the oven chamber of FIG. 2.
Figure 6:
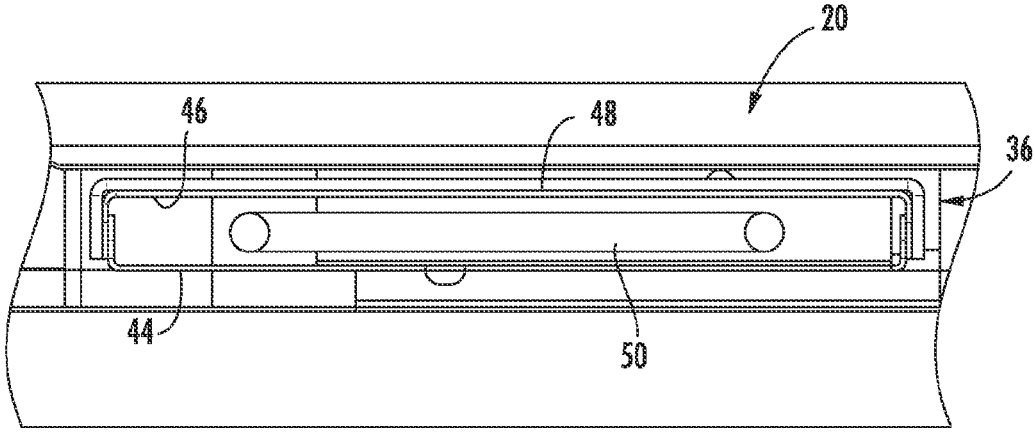
FIG. 6 is a fragmentary side sectional view of the oven chamber and heating element assembly of FIG. 2.

Referring to FIG. 4, heating element assembly may be accessed for quick and easy removal, replacement, maintenance, or the like. To access heating element assembly 20, oven chamber 12 is slid out from wall 70 and heating element assembly 20 may be slid out from space 36. A panel or door 72 mounted on a hinge 74 may be provided to cover opening in side 26 of oven chamber 12.

The oven may be operated in one of a plurality of modes, depending on the type of cooking desired. Although not to be considered as limiting, one basic operating method which may generally apply to each of the various operating modes may include heat being provided by heating element assembly 20 and/or convection heat source 18. The heat sources may be turned on by the control module only when desired or at certain times during the cooking operation.

While the components of the disclosed embodiments will be illustrated as a heating element for use in convection oven built in a wall, designed for other oven arrangements, the features of the disclosed embodiments have a much wider applicability. For example, the heating element assembly is adaptable for other oven applications such as stand-alone ranges, grills and other home, consumer, commercial, or industrial ovens which employ a storage space configured to rotate relative to a base. Further, the size of the various components and the size of the oven and/or heating element can be widely varied.

It is also important to note that the construction and arrangement of the elements of the oven heating element as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the oven may be a wall mounted single or dual oven, incorporated in a range, a stand alone appliance, or the like. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. An oven comprising:

an oven chamber having a cavity defined by a door and a plurality of walls which include a first wall;

a heating element assembly located adjacent the first wall and configured to provide heat energy to the cavity, the heating element assembly comprising a heating element and a shield located between the heating element and the first wall of the oven chamber wherein the heating element transfers heat energy to the shield and the shield transfers the heat energy to the first wall;

a plane extending through a center of the cavity and generally parallel to the door, wherein the heating element comprises a geometric center located between the plane and the door;

wherein the heating element includes a U-shaped member having a front member, a rear member, and a middle member extending between the front member and the rear member, the front member is located between the rear member and the door;

wherein the front member and the rear member extend substantially between a pair of opposing side walls.

2. The oven of claim 1 wherein the heating element is located outside the cavity.

3. The oven of claim 2 wherein the plurality of walls further include a pair of side walls, a rear wall, a top wall, and the first wall is a bottom wall.

4. The oven of claim 1 wherein the rear member of the heating element is located between the plane and the door.

5. The oven of claim 1 wherein the heating element also transfers heat to air surrounding the heating element assembly, which then also transfers heat energy to the first wall.

6. An oven comprising:

an oven chamber movable between a first position and a second position, the oven chamber having a cavity formed by a pair of opposing side walls, a rear wall, a door opposite the rear wall, a bottom wall, the cavity having a plane extending midway between the rear wall and the door and generally parallel with the door;

a heating element located below the bottom wall and having a geometric center point;

wherein the center of the heating element is located between the plane of the cavity and the door so that more heat is provided to a front portion of the cavity than a rear portion of the cavity;

an access panel located on a side of the oven chamber and movable to provide access to the heating element;

wherein the access panel is accessed when the oven chamber is in the second position by moving the oven chamber forward away from the first position.

7. The oven of claim 6 wherein the heating element is located in a space below the bottom wall and is at least partially defined by the bottom wall and a subwall.

8. The oven of claim 7 wherein the space between the bottom wall of the oven chamber and the subwall is provided without insulation.

9. The oven of claim 7 wherein the heating element assembly is not surrounded by insulation.

10. An oven comprising:

an oven chamber having a cavity formed by a pair of opposing side walls, a rear wall, a door opposite the rear wall, and a bottom wall, the cavity having a first plane extending midway between the rear wall and the door and dividing the cavity into a rear portion and a front portion;

a heating element assembly located below the bottom wall and comprising a heating element and a shield located between the heating element and the bottom wall of the oven chamber;

wherein the heating element is located substantially between the first plane and a second plane extending through the door so that more heat is provided to the front portion of the cavity than the rear portion of the cavity.

11. The oven of claim 10 wherein the heating element assembly further comprises a bracket for mounting the heating element below the bottom wall of the cavity.

12. The oven of claim 11 wherein the oven chamber comprises a subwall and the bracket comprises a lower bracket coupled to the subwall and an upper bracket coupled to the lower bracket.

13. The oven of claim 11 wherein the shield is located between the bracket and the bottom wall of the oven chamber and configured to evenly distribute heat to the bottom wall.

14. The oven of claim 13 wherein the shield comprises a plate and flanges extending from the plate to engage the bracket.

15. The oven of claim 14 wherein the shield is metallic.

16. The oven of claim 15 further comprising an air gap between the shield and the bottom wall of the oven chamber to provide convected heat transfer from the shield to the bottom wall.

17. The oven of claim 10 furthers comprising an access panel movable between a closed position and an open position to provide access to the heating element.

18. The oven of claim 10 wherein the heating element is completely located between the plane and a second plane extending through the door.

19. The oven of claim 10 wherein the heating element includes a U-shaped member having a front member, a rear member, and a middle member extending between the front member and the rear member, the front member is located between the rear member and the door; wherein the front member and the rear member extend substantially between a pair of opposing side walls.

* * * * *